US009132451B1

(12) United States Patent
Tankhilevich

(10) Patent No.: US 9,132,451 B1
(45) Date of Patent: Sep. 15, 2015

(54) USING TUNNEL JUNCTION AND BIAS FOR EFFECTIVE CURRENT INJECTION INTO MAGNETIC PHONON-GAIN MEDIUM

(71) Applicant: Boris G. Tankhilevich, Walnut Creek, CA (US)

(72) Inventor: Boris G. Tankhilevich, Walnut Creek, CA (US)

( * ) Notice: Subject to any disclaimer, the term of this patent is extended or adjusted under 35 U.S.C. 154(b) by 0 days.

(21) Appl. No.: 14/517,801

(22) Filed: Oct. 18, 2014

Related U.S. Application Data

(63) Continuation-in-part of application No. 13/661,053, filed on Oct. 26, 2012, now Pat. No. 8,891,335.

(51) Int. Cl.
*B06B 1/00* (2006.01)
*B06B 1/04* (2006.01)

(52) U.S. Cl.
CPC ..... *B06B 1/04* (2013.01)

(58) Field of Classification Search
CPC ..... B06B 1/04
See application file for complete search history.

(56) References Cited

U.S. PATENT DOCUMENTS

| | | | |
|---|---|---|---|
| 7,411,445 | B2 | 8/2008 | Kucherov et al. |
| 7,430,074 | B2 | 9/2008 | Korenblit et al. |
| 7,507,302 | B2 | 3/2009 | Miyoshi et al. |
| 7,508,578 | B2 | 3/2009 | Korenblit et al. |
| 7,649,679 | B2 | 1/2010 | Ajiki et al. |
| 7,986,454 | B1 | 7/2011 | Korenblit et al. |
| 2010/0019798 | A1 | 1/2010 | Saito et al. |
| 2011/0101250 | A1 | 5/2011 | Hu |
| 2014/0119161 | A1 | 5/2014 | Tankhilevich et al. |

OTHER PUBLICATIONS

Hiroaki Sukegawa et al., "Spin-transfer switching in full-Heusler Co2FeAl-based magnetic tunnel junctions", Applied Physics Letters, vol. 100, 182403, Apr. 2012.
Coey et al. "Half-metallic ferromagnetism: Example of CrO2", Journal of Applied Physics, vol. 91, No. 10, pp. 8345-8350, May 2002.
Shan et al. "Demonstration of Half-Metallicity in Fermi-Level-Tuned Heusler Alloy CO2FeAl0.5Si0.5 at Room Temperature", Physical Review Letters 102, 246601, Jun. 19, 2009.
Korenblit et al. "Generation of High-Frequency Magnons by NonEquilibrium Electrons Polarized Opposite to the Direction of Magnetization", Soviet Physics, JETP, vol. 46(6), pp. 1167-1175, Dec. 1977.
Korenblit et al. "Generation of High-Frequency Magnons in a Ferromagnetic Semiconductor", Pis'ma Zh. Eksp. Teor. Fiz. 24, No. 11, pp. 598-601, Dec. 1976.

(Continued)

*Primary Examiner* — Luke Ratcliffe
*Assistant Examiner* — Hovhannes Baghdasaryan
(74) *Attorney, Agent, or Firm* — Boris G. Tankhilevich

(57) ABSTRACT

An apparatus for generating ultra-high frequency sound waves with frequencies between (1 GHz-10 GHz) is proposed. The apparatus comprises a magnetic phonon-gain medium configured to generate high frequency non-equilibrium phonons by non-equilibrium magnons having the magnon velocity exceeding the sound velocity in the magnetic phonon-gain medium. The non-equilibrium magnons having the magnon velocity exceeding the sound velocity in the magnetic phonon-gain medium are generated by injected via a tunnel junction non-equilibrium electrons having spin opposite to the direction of magnetization of the magnetic phonon-gain medium.

16 Claims, 2 Drawing Sheets

(56) References Cited

OTHER PUBLICATIONS

Korenblit et al. "High Frequency Magnon Generation by NonEquilibrium Electrons and the Instability of the Magnon System", Physics Letters, vol. 64A, No. 3, pp. 307-308, Dec. 1977.

Akhiezer et al. "Spin Waves", North-Holland Series in Low Temperature Physics, vol. 1, pp. 268-275, 1968.

Wurmehl et al. "Geometric, electric, and magnetic structure of Co2FeSi: Curie temperature and magnetic moment measurements and calculations", Physical Review B 72, 184434, 2005.

Kittel "Quantum Theory of Solids", John Wiley & Sons, Inc., 1963.

Swartz "Thermal boundary resistance", Reviews of Modern Physics, vol. 61, No. 3, pp. 605-668, Jul. 1989.

U.S. Appl. No. 13/661,053: Notice of Allowance and Fee(s) Due dated Oct. 22, 2014.

USING TUNNEL JUNCTION AND BIAS FOR EFFECTIVE CURRENT INJECTION INTO MAGNETIC PHONON-GAIN MEDIUM

This is the continuation-in-part application for the U.S. patent application Ser. No. 13/661,053, filed on Oct. 26, 2012, and entitled "GENERATION OF ULTRA-HIGH FREQUENCY SOUND".

TECHNICAL FIELD

The technology relates to the generation of ultra-high frequency (1-10) GHz sound.

BACKGROUND

In the parent U.S. patent application Ser. No. 13/661,053, filed on Oct. 26, 2012, and entitled "GENERATION OF ULTRA-HIGH FREQUENCY SOUND", the generation of ultra-high frequency (1-10) GHz sound was disclosed.

In the present patent application an efficient technique for injection of electrical current into sub band having spin opposite to the direction of magnetization of the ferromagnetic conductive material is disclosed.

SUMMARY

This Summary is provided to introduce a selection of concepts that are further described below in the Detailed Description. This Summary is not intended to identify key or essential features of the claimed subject matter, nor is it intended to be used as an aid in determining the scope of the claimed subject matter.

An apparatus for generating ultra-high frequency sound waves with frequencies between (1 GHz-10 GHz) is proposed.

The apparatus of the present technology comprises a ferromagnetic conductive material including a magnetic phonon-gain medium; wherein non-equilibrium electrons having the spin orientation opposite to the direction of magnetization of the magnetic phonon-gain medium are injected into the ferromagnetic material; and wherein non-equilibrium magnons are generated in the magnetic phonon-gain medium while the non-equilibrium electrons propagate in the magnetic phonon-gain medium and change the spin orientation from the direction opposite to the direction of magnetization of the magnetic phonon-gain medium to the direction along to the direction of magnetization of the magnetic phonon-gain medium.

The apparatus of the present technology further comprises a tunnel junction coupled to the ferromagnetic conductive material, wherein electrons are injected into the ferromagnetic conductive material from an external metallic contact by tunneling via the tunnel junction.

The apparatus of the present technology further comprises a means for outputting the ultra-high frequency non-equilibrium phonons generated in the magnetic phonon-gain medium by non-equilibrium magnons having the magnon velocity exceeding the sound velocity in the magnetic phonon-gain medium.

DESCRIPTION OF THE DRAWINGS

The accompanying drawings, which are incorporated in and form a part of this specification, illustrate embodiments of the technology and, together with the description, serve to explain the principles below.

DETAILED DESCRIPTION

Reference now is made in detail to the embodiments of the technology, examples of which are illustrated in the accompanying drawings. While the present technology will be described in conjunction with the various embodiments, it will be understood that they are not intended to limit the present technology to these embodiments. On the contrary, the present technology is intended to cover alternatives, modifications and equivalents, which may be included within the spirit and scope of the various embodiments as defined by the appended claims.

Furthermore, in the following detailed description, numerous specific-details are set forth in order to provide a thorough understanding of the presented embodiments. However, it will be obvious to one of ordinary skill in the art that the presented embodiments may be practiced without these specific details. In other instances, well known methods, procedures, components, and circuits have not been described in detail as not to unnecessarily obscure aspects of the presented embodiments.

Figure 1:
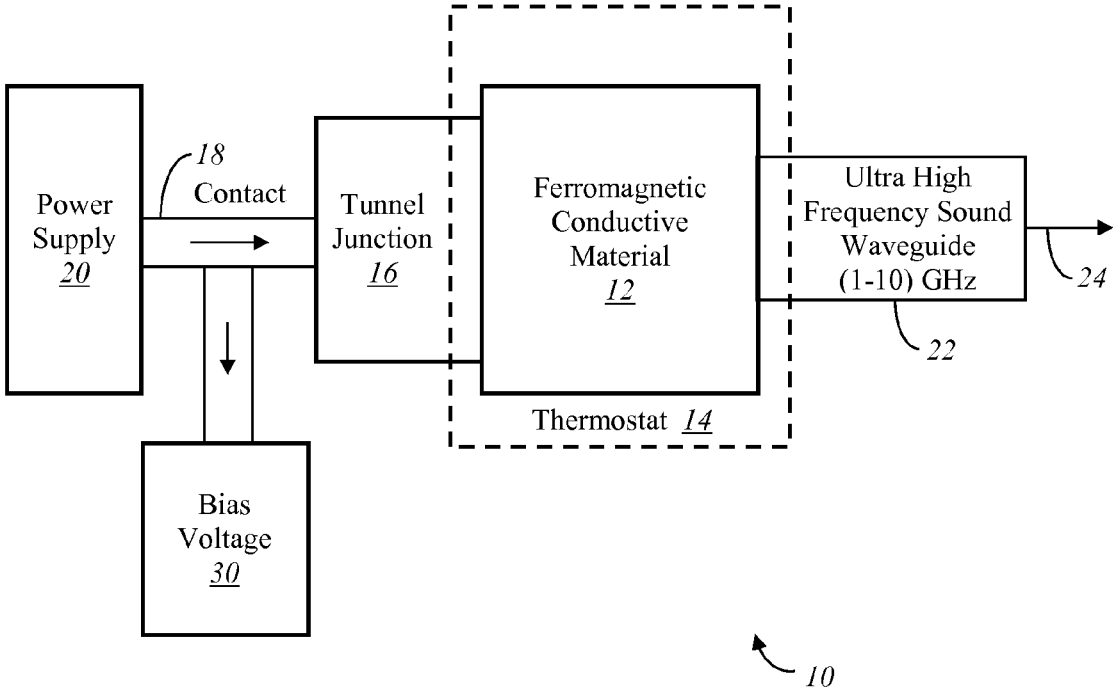
FIG. 1 depicts a block diagram of the apparatus of the present technology comprising a ferromagnetic conductive material, a tunnel junction, and a bias voltage applied to the contact.

In an embodiment of the present technology, FIG. 1 depicts a block diagram 10 of the apparatus comprising a ferromagnetic conductive material 12 further including a magnetic phonon-gain medium (not shown), a tunnel junction 16 coupled to the ferromagnetic conductive material 12, and a bias voltage 30 applied to the contact 18. The external power supply 20 injects electrons having both spins up and down via contact 18 and via the tunnel junction 16 into the ferromagnetic conductive material 12. The Ultra High Frequency Sound Waveguide 22 is configured to output the non-equilibrium high frequency phonons 24 having frequency in the range of (1-10) GHz. A means for outputting the ultra-high frequency non-equilibrium phonons (not shown) generated in the magnetic phonon-gain medium by non-equilibrium magnons having the magnon velocity exceeding the sound velocity in the magnetic phonon-gain medium can be implemented by using the Ultra High Frequency Sound Waveguide 22. The Ultra High Frequency Sound Waveguide 22 can be implemented by using an ultrasonic horn. Ultrasonic horn (also known as acoustic horn, sonotrode, acoustic waveguide, ultrasonic probe) is necessary because the amplitudes provided by the transducers themselves are insufficient for most practical applications of power ultrasound. Another function of the ultrasonic horn is to efficiently transfer the acoustic energy from the ultrasonic transducer into the treated media, which may be solid (for example, in ultrasonic welding, ultrasonic cutting or ultrasonic soldering) or liquid (for example, in ultrasonic homogenization, sonochemistry, milling, emulsification, spraying or cell disruption). Ultrasonic processing of liquids relies of intense shear forces and extreme local conditions (temperatures up to 5000 K and pressures up to 1000 atm) generated by acoustic cavitation. The ultrasonic horn is commonly a solid metal rod with a round transverse cross-section and a variable-shape longitudinal cross-section—the rod horn. Another group includes the block horn, which has a large rectangular transverse cross-section and a variable-shape longitudinal cross-section, and more complex composite horns. The devices from this group are used with solid treated media. The length of the device must be such that there is mechanical resonance at the desired ultrasonic frequency of operation—one or multiple half wavelengths of ultrasound in the horn material, with sound speed dependence on the horn's cross-section taken into account. In a common assembly, the ultrasonic horn is rigidly connected to the ultrasonic transducer using a threaded stud.

Figure 2:
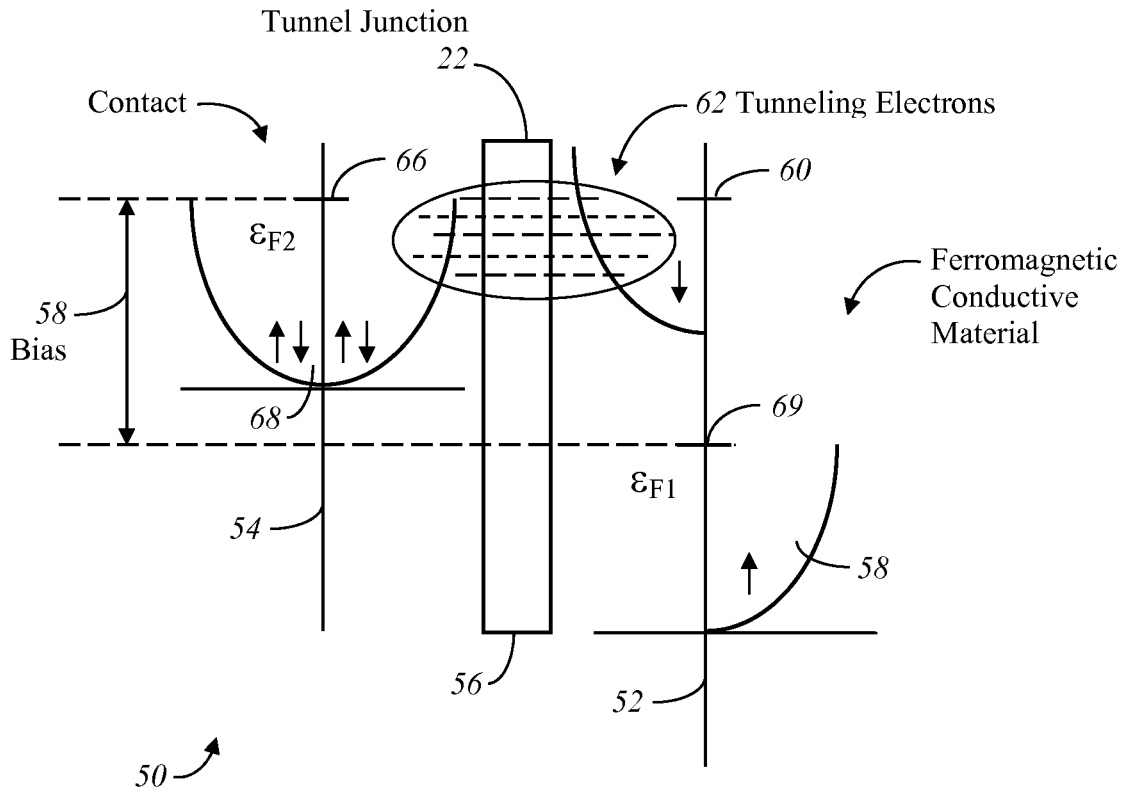
FIG. 2 illustrates shifting of the Fermi level of the external metallic contact with respect to the Fermi level of the ferromagnetic conductive material by applying a bias voltage so that the injected electrons are configured to tunnel into the second sub band having spin down for the purposes of the present technology.

In an embodiment of the present technology, as shown in the diagram 50 of FIG. 2, the magnetic phonon-gain medium (not shown) further comprises a conduction band that is split into two sub bands separated by an exchange energy gap, a first sub band 58 having spin up, and a second sub band 60 having spin down.

In an embodiment of the present technology, FIG. 2 further illustrates the application of the bias voltage 58 used to shift the Fermi level 66 of the external metallic contact 54 with respect to the Fermi level 69 of the ferromagnetic conductive material 52 so that the injected electrons 62 are tunneling into the second sub band 60 having spin down.

In an embodiment of the present technology, the ferromagnetic conductive material (12 of FIG. 1) is selected from the group consisting of: a ferromagnetic semiconductor; a dilute magnetic semiconductor (DMS); a half-metallic ferromagnet (HMF); and a ferromagnetic conductor, with a gap in the density of states of the minority electrons around the Fermi energy.

Recently some dilute magnetic semiconductors (DMS), with Tc above room temperature, have been studied intensively. These are oxides doped with magnetic cations. The examples are: GaN, doping Mn-9%, Tc=940 K; AlN, doping Cr-7%, Tc>600 K; TiO2 (anatase), doping Co-7%, Tc=650 K; $SnO_2$, doping Co-5%, Tc=650 K. These magnets can be used as a magnon gain medium (MGM) to generate nonequilibrium magnons and photons at room temperatures.

In an embodiment of the present technology, the half-metallic ferromagnet (HMF) is selected from the group consisting of a spin-polarized Heusler alloy; a spin-polarized Colossal magnetoresistance material; and $CrO_2$.

Half-metallic ferromagnets (HMF) are ferromagnetic conductors, with a gap in the density of states of the minority electrons around the Fermi energy, $E_f$. Thus, the electrons in these materials are supposed to be 100% spin polarized at $E_f$. Thermal effects and spin-orbital interactions reduce the electron polarization. However, the electron polarization is close to 100% in half-metallic ferromagnets with spin-orbital interaction smaller than the minority electron gap and at temperatures much lower than the Curie temperature Tc.

Half-metallic ferromagnets (HMF) form a quite diverse collection of materials with very different chemical and physical properties.

Chromium dioxide, $CrO_2$. Tc=390 K. Magnetic moment per Cr=2 μB. The polarization measured at low temperatures is close to 100%. There are some other known half-metallic ferromagnetic oxides, e.g. $Sr_2FeMoO_6$.

Heusler alloys. Most of the predicted HMF is Heusler alloys. In general, these are ternary $X_2YZ$-compounds, X and Y are usually transition metals and Z is a main group element. The most studied of them is NiMnSb:Tc=728 K, with magnetic moment close to 4 μB. Experiments show that NiMnSb is a half-metallic ferromagnet at low temperatures. But there is evidence that at T≈90 K a phase transition into a usual ferromagnetic state takes place, and it seems unlikely that NiMnSb is a half-metallic ferromagnet near room temperature.

There are many other Heusler alloys with half-metallic ferromagnet properties, like: (1) $Co_2MnSi$ having Tc of 1034 K and magnetic moment of 5 μB; (2) $Co_2MnGe$ having Tc of 905 K and magnetic moment close to 5 μB; and (3) $Co_2MnSn$ having Tc of 826 K and magnetic moment of 5.4 μB; etc.

Colossal magnetoresistance materials: $La_{1-x}Sr_xMnO_3$ (for intermediate values of x) is presumably a half-metallic ferromagnet having Tc close to room temperature. Photoelectron emission experiments confirm the half-metallicity of $La_{0.7}Sr_{0.3}MnO_3$, with Tc=350 K. The polarization degree at T=40K is 100±5%, the gap for the minority spins is 1.2 eV.

In an embodiment of the present technology, the spin-polarized Heusler alloy is selected from the group consisting of $Co_2FeAl_{0.5}Si_{0.5}$; NiMnSb; $Co_2MnSi$; $Co_2MnGe$; $Co_2MnSn$; $Co_2FeAl$ and $Co_2FeS$.

It has been shown recently (S. Wurmehl et al., PRB 72, 184434 (2005)), that the alloy with the highest magnetic moment and Tc is $Co_2FeSi$ having Tc of 1100 K (higher than for Fe), and having magnetic moment per unit cell of 6 μB. The orbital contribution to the moments is small, while the exchange gap is large, of order 2 eV. Therefore, the effect of thermal fluctuations and spin-orbit interaction on the electron polarization is negligible. One should expect, therefore, that the electrons in $Co_2FeSi$ are polarized at high temperatures, sufficiently close to Tc. Indeed, according to the experiment the magnetic moment at 300 K is the same as at 5 K.

Note that HMF, as well as ferromagnetic semiconductors, differ from "normal" metallic ferromagnets by the absence of one-magnon scattering processes. Therefore, spin waves in HMF, as well as in magnetic insulators, are well defined in the entire Brillouin zone. This was confirmed by neutron scattering experiments performed on some Heusler alloys. For references, please see: (1) Y. Noda and Y. Ishikawa (*J. Phys. Soc. Japan v.* 40, 690, 699 (1976)) have investigated the following Heusler alloys: $Pd_2MnSn$ and $Ni_2MnSn$. (2) K. Tajima et al. (*J. Phys. Soc. Jap. v.*43, 483 (1977)), have investigated Heusler alloy $Cu_2MnAl$.

Thus, all these above disclosed magnets can be used as a magnetic phonon-gain medium (MGM) to generate ultra-high frequency sound waves with frequencies between (1 GHz-10 GHz) nonequilibrium magnons and photons at room temperatures for the purposes of the present technology.

In an embodiment of the present technology, referring still to FIG. 1, the tunnel junction 16 is selected from the group consisting of a thin insulating layer between the contact 18 and the ferromagnetic conductive material 12, or a bias between the contact 18 and the ferromagnetic conductive material 12.

In electronics, a tunnel junction is a barrier, such as a thin insulating layer or electric potential, between two electrically conducting materials.

The current densities of $10^7$ A/cm$^2$ (well above the critical pumping currents of order of ($10^5$-$10^6$) A/cm$^2$ that we need) were achieved by using very thin tunnel junctions. For reference, please see: "*Spin-transfer switching in full-Heusler Co2FeAl-based magnetic tunnel junctions*;" by Hiroaki Sukegawa, Zhenchao Wen, Kouta Kondou, Shinya Kasai, Seiji Mitani, and Koichiro Inomata, Applied Physics Letters, 100, 182403 (2012), Thus, applying the threshold current density for achieving the magnon lasing threshold is feasible in the proposed apparatus 10 of FIG. 1.

Electrons (or quasi-particles) pass through the barrier by the process of quantum tunneling. Classically, the electron has zero probability of passing through the barrier. However, according to quantum mechanics, the electron has non-zero wave amplitude in the barrier, and hence it has some probability of passing through the barrier.

Tunneling is often explained using the Heisenberg uncertainty principle and the wave-particle duality of matter. Purely quantum mechanical concepts are central to the phenomenon, so quantum tunneling is one of the novel implications of quantum mechanics.

In an embodiment of the present technology, referring still to FIG. 2, the tunnel junction 22 is used to separate two electronic systems from each other: the electronic system of the ferromagnetic conductive material 52 and the electronic system of contact 54.

In an embodiment of the present technology, as shown in FIG. 2, because the tunnel junction 22 separates two electronic systems of the ferromagnetic conductive material 52 and of the electronic system of contact 54, the external boas voltage 56 can be applied to the contact 54 to shift its Fermi level $E_{F2}$ 66 with respect to the Fermi level $E_{F1}$ 69 of the ferromagnetic conductive material 52.

In an embodiment of the present technology, as shown in FIG. 2, the electrons injected into the ferromagnetic material 52 via tunnel junction 22 are tunneling (62) into the upper sub band with spin down 60, flip their spin and emit magnons by entering the sub band with spin up 58 thus effectively initiating the process of generation of ultra-high frequency sound waves with frequencies between (1 GHz-10 GHz) disclosed below.

I. Cherenkov Type Phonon Excitation by Magnons

We propose a method for generating ultra-high-frequency sound, with frequency of GHz and higher, in spin-polarized ferromagnetic materials like half-metals. In these materials the conduction bands are split by the exchange interaction into two sub bands with opposite spin orientation, and only electron states in the lower sub band ("spin up" majority electron states) are occupied at zero temperature.

Non-equilibrium electrons pumped into the upper sub band ("spin-down" minority electron states) rapidly emit magnons, with frequencies in the THz region (not shown).

In an embodiment of the present technology, at critical pumping currents of order of $(10^5\text{-}10^6)$ A/cm$^2$ the number of magnons in a smooth frequency interval increases exponentially with pumping. For more details, please see I. Ya. Korenblit and B. G. Tankhilevich, *Sov. Phys.—JETP,* 46, 1167 (1977); I. Ya. Korenblit and B. G. Tankhilevich, *Sov. Phys.—JETP Lett.* 24, 555 (1976); I. Ya. Korenblit and B. G. Tankhilevich, *Phys. Lett. A* 64, 307 (1977).

In an embodiment of the present technology, magnons with sufficiently high frequency and, hence, large velocity can emit sound waves (phonons) in a process akin to Cherenkov radiation of electromagnetic waves by fast electrons.

The spectrum of the magnons is $$\epsilon(q)=\hbar\,\Omega(q)=Dq^2, \tag{1}$$

where $\epsilon(q)$ and $\Omega(q)$ are respectively the energy and the frequency of the magnon, q is the magnon wave vector, D is the magnon stiffness, and $\hbar$ is the Plank constant.

Hence, the magnon velocity is $v_m=2Dq/\hbar$ . and the sound wave excitation takes place if the magnon frequency $\Omega_q=2\pi f_q$ satisfies the following inequality $$\Omega_q \geq \hbar\, u^2/4D. \tag{2}$$

For the reference, please, see A. I. Akhiezer, V. G. Baryakhtar, and S. V. Peletminskii, *Spin Waves, Amsterdam: North-Holland*, (1968), pages (268-275).

In an embodiment of the present technology, in half-metals, with Curie temperatures, Tc, higher than the room temperature, the stiffness varies from D≈100 me V·Å$^2$ in chromium dioxide (Tc=390 K) (please, see the reference J. M. D. Coey and M. Venkatesan, *J. Appl. Phys.* 91, 8345 (2002)) to D≈370 me V·Å$^2$ in Heusler alloy $Co_2FeAl$ ($T_c$≈1000 K) (please, see the reference S. Wurmel et al., *Phys. Rev.* 72, 184434 (2005)).

In an embodiment of the present technology, assuming for the sound velocity a typical value $u=5\cdot10^5$ cm/s, one can deduct, that magnons, with frequencies larger than several THz, emit phonons in the Cherenkov process.

In an embodiment of the present technology, in a conductor with a simple parabolic electron band the non-equilibrium electrons emit magnons in a smooth wave vector interval $q_0-\kappa\leq q_0+\kappa$, where $\hbar\, q_0=\sqrt{(2m\Delta)}$, m is the electron mass, Δ is the electron exchange gap, and $p=\hbar\,\kappa$ is the momentum of the electrons in the upper (spin-down) sub band, while it is supposed that κ/qo is small. Thus, the frequency of the excited magnons is close to the value $\Omega(q_0)=2mD\Delta/\hbar^3$. With the above values of D and with Δ≈1 meV and m equal the free electron mass, one gets $\Omega(q_0)$=50-150 THz. In what follows we shall use for numerical estimates the value $\Omega(q_0)$=100 THz.

II. Magnon-Phonon Interaction

The probability, W(q, $q_1$, k) that a magnon with wave-vector q excites a phonon with wave-vector k and frequency $\omega_k$=uk, and transforms into a magnon with wave-vector $q_1$ reads. Please, see A. I. Akhiezer, V. G. Baryakhtar, and S. V. Peletminskii, *Spin Waves, Amsterdam: North-Holland*, (1968), pages (268-275).

$$W(q,q_1,k)=2\pi\hbar^{-1}|\Psi(q,q_1,k)|^2N_q(N_{q1}+1)(n_k+1)\delta(\epsilon_q-\epsilon_{q1}-\hbar\,\omega_k)\delta(q-q_1-k). \tag{3}$$

Here $N_q$ and $n_k$ are respectively the distribution function of the magnons and phonons, and the amplitude Ψ is given by:

$$\Psi=bDa^{-3/2}\hbar^{1/2}(\rho\omega_k)^{-1/2}qq_1k, \tag{4}$$

where a is the lattice constant, ρ is the material density, and b is a constant of order unity.

Thus, the change of the number of phonons with time due to the phonon-magnon interaction can be written as $$\begin{aligned}(\partial n_k/\partial t)_{mf}&=2\pi\hbar^{-1}(a/2\pi\hbar)^3\int d^3q|\Psi|^2[(N(\epsilon_q)(N(\epsilon_q-\hbar\,\omega_k)+1)(n(\omega_k)+1)(-)n(\omega_k)N(\epsilon_q-\hbar\,\omega_k)(N(\epsilon_q)+1)]\delta(\epsilon_q-\epsilon_{q-k}-\hbar\,\omega_k)\\&=2\pi\hbar^{-1}(a/2\pi\hbar)^3\int d^3q|\Psi|^2[(N(\epsilon_q)(N(\epsilon_q-\hbar\,\omega_k)+n(\omega_k)+1)(-)N(\epsilon_q-\hbar\,\omega_k)n(\omega_k)]\delta(\epsilon_q-\epsilon_{q-k}-\hbar\,\omega_k),\end{aligned} \tag{5}$$

with $|\Psi|^2$ given by $$|\Psi|^2=\hbar\,k^2b^2a^{-3}(\rho\omega_k)^{-1}(\epsilon_q-\hbar\,\omega_k). \tag{6}$$

It follows from the energy conservation law that the angle, θ, between the direction of the magnon wave vector, q, and the phonon wave vector, k, is:

$$\cos\theta=(k/2q)+(u/v_m). \tag{7}$$

This equation shows that, as noticed before, the phonon emission takes place only if u is less than $v_m$, while the phonon wave vector k varies from k=0 till $k=2q(1-u/v_m)$.

In an embodiment of the present technology, we are looking for instability in the phonon system, when $n_k$ increases exponentially with time. Therefore only terms proportional to $n_k$ are important in the left side of the equation (6), and we get $$(\partial n_k/\partial t)_{mf}=(n_k/\tau_{mf}), \tag{8}$$

where the magnon-phonon relaxation time $\tau_{mf}$ is given by $$1/\tau_{mf}=2\pi\hbar^{-1}(a/2\pi\hbar)^3\int d^3q|\Psi|^2[(N(\epsilon_q)-(N(\epsilon_q-\hbar\,\omega_k)]\delta(\epsilon_q-\epsilon_{q-k}-\hbar\,\omega_k). \tag{9}$$

In an embodiment of the present technology, we consider in what follows only isotropic systems. Then, as shown in I. Ya. Korenblit and B. G. Tankhilevich, *Sov. Phys.—JETP,* 46, 1167 (1977); I. Ya. Korenblit and B. G. Tankhilevich, *Sov.*

*Phys.—JETP Lett.* 24, 555 (1976); I. Ya. Korenblit and B. G. Tankhilevich, *Phys. Lett. A* 64, 307 (1977), the non-equilibrium distribution function of magnons is:

$$N_q=[N^{(0)}_q+1][(q/(q-\kappa^{t+1}-1)+(\kappa/q_0)\exp(-g/g_c)]^{-1}>>N^{(0)}_q, \quad (10)$$

if q belongs to the interval $q_0-\kappa\leq q_0+\kappa$, and $Nq=N^{(0)}_q$ for other wave-vectors.

Here g is the intensity of electron pumping, and $g_c$ is the critical pumping, t is the exponent in the q-dependence of the magnon-magnon relaxation time: t=3 for magnons with energy $\epsilon_q$ larger than $k_BT$, and t=4 for magnons with energy $\epsilon_q$ smaller than $k_BT$, wherein $k_B$ is Boltzmann constant. The relation (10) holds at sufficiently high pumping intensity $g>>g_c$.

In an embodiment of the present technology, the typical energy of excited magnons exceeds $k_BT$. Therefore in what follows we put t=3 and we neglect $N^{(0)}_{q0}$ in comparison with unity. If the energy of excited magnons less than $k_BT$, the same approximation can be used.

In an embodiment of the present technology, if the inequality $$\omega_k>\Omega(q_0+k)-\Omega(q_0-k)\approx(4k/q_0)\Omega(q_0)<<\Omega(q_0) \quad (11)$$

holds, the magnons with energy $(\epsilon_q-\hbar\omega_k)$ are outside the non-equilibrium region, and therefore $N(\epsilon_q-\hbar\omega_k)$ in Eq (9) may be neglected. As shown FIG. 3, this implies that only direct processes 60 of phonon 70 excitation by non-equilibrium magnons 68 take place, while the opposite processes of phonon absorption (not shown) do not matter.

Substituting Nq from Eq (10) into Eq (9), one gets in this case:

$$1/\tau_{mf}=(16\pi)^{-1}\hbar^3(\rho u)^{-1}D^{-2}\Omega(q_0)^3(g/g_c),\ \omega_k>(4k/q_0)\Omega(q_0). \quad (12)$$

Here and in what follows we ignore the constant b≈1. Note that $\tau_{mf}$ does not depend on the phonon frequency.

In an embodiment of the present technology, ωk is smaller than $(4k/q_0)\Omega(q_0)$, the absorption processes reduces the overall generation rate of phonons, and the phonon generation frequency $(1/\tau_{mf})$ decreases with the decrease of $\omega_k$:

$$1/\tau_{mf}=(64\pi)^{-1}\hbar^3(\rho uk)^{-1}D^{-2}\Omega(q_0)^2q_0\omega_k,\ \omega_k<<(4k/q_0)\Omega(q_0). \quad (13)$$

III. Phonon Instability

The change of $n_k$ with time is governed by the equation:

$$(\partial n_k/\partial t)=(n_k/\tau_{mf})-((n_k-n^0_k)/\tau)=0. \quad (14)$$

The second term in the r.h.s. of the equation (14) describes the relaxation of $n_k$ to its equilibrium value $n^0_k$, and τ can be written as:

$$\tau^{-1}=(\tau_{fe})^{-1}+(\tau_{ff})^{-1}+(\tau_{fi})^{-1}+(\tau_{fb})^{-1}, \quad (15)$$

where the relaxation times $\tau_{fe}$, $\tau_{ff}$, $\tau_{fi}$, and $\tau_{fb}$ are due to electron-phonon, phonon-phonon, mass-difference impurity scattering, and boundary scattering, respectively.

It follows from Eq (14) that $n_k$ increases exponentially with time $$N=C\exp[(\tau^{-1}_{mf}-\tau^{-1})t] \quad (16)$$

if $\tau^{-1}_{mf}$ is larger than $\tau^{-1}$, i.e. if the phonon generation by magnons exceeds their absorption.

In an embodiment of the present technology, the phonon relaxation in metals is mainly due to phonon-electron and boundary scattering. The relaxation time $\tau_{fe}$ is (please, see C. Kittel, *Quantum Theory of Solids*, J. Willey and Sons, N.Y.-London (1963)) pages (326-329)):

$$1/\tau_{fe}=2(9\pi)^{-1}\hbar^{-3}(\rho u)^{-1}E^2_f(m)^2\omega_k,\ (kl>>1), \quad (17)$$

and $$1/\tau_{fe}=8(15)^{-1}(\rho vu^2)^{-1}nE_f1\omega^2_k,\ (kl<<1) \quad (18)$$

where $E_f$ is the electron Fermi energy, l is the electron mean-free path, and n is the electron concentration.

In an embodiment of the present technology, at very high phonon frequencies, when the inequality (11) is fulfilled, the phonon-electron relaxation is given by the first of the above equations, and the ratio $\tau_{fe}/\tau_{mf}$ is given by:

$$\tau_{fe}/\tau_{mf}=\Delta^2(g/4g_c)E_f^{-2}q_0\kappa^{-1}. \quad (19)$$

This ratio is larger than unity only for very large $(q_0/\kappa)$ and very high levels of pumping. Thus, it would be difficult to achieve the instability of the phonon system at such frequencies.

In an embodiment of the present technology, for lower phonon frequencies the phonon-electron relaxation decreases with frequency as $\omega^2_k$, see Eq. (18), while the phonon generation decreases as $\omega_k$. Therefore, at sufficiently low frequencies, the phonon generation by magnons exceeds their absorption by electrons. This happens at frequencies less than $\omega_k$=(10-100) GHz.

But at these frequencies the boundary scattering which does not depend on frequency may compete with the phonon-electron scattering. It is usually assumed that the boundary scattering takes place without change of energy and without change in the number of phonons. Only transmission of phonons into the environment decreases $n_k$. The transmission coefficient depends on the mismatch in sound velocities and densities of the ferromagnet and of the environment, and it is small, when the mismatch is large (please, see E. T. Swartz and R. O. Pohl, *Rev. Mod. Phys.* 61, 605 (1983)). Therefore, the boundary relaxation time can be written as $$\tau_{fb}^{-1}=L\mu/u, \quad (20)$$

where L is the dimension of the system and μ<<1 is the transition coefficient. We suppose that μ does not depend on the phonon frequency.

It follows than from Eqs. (13), (18) and (20) that the instability relation $$\tau_{mf}^{-1}\geq\tau_{fe}^{1}+\tau_{fb}^{-1}, \quad (21)$$

is satisfied if the sample dimension L is larger than the following value $$L\geq(8\pi\kappa\hbar^3\Delta^{-2}q^{-1}_0)^2n\rho vum^{-5/2}\mu l\approx10^6\mu l. \quad (22)$$

With $l\approx(10^{-5}\text{-}10^{-4})$ cm, and $\mu=10^{-3}$, one gets $L\geq L_c\approx(10^{-2}\text{-}10^{-3})$ cm.

In an embodiment of the present technology, when the parameters are such that in Eq (21) the equality takes place, only one frequency, ω*, given by the relation $$\omega^*=(m\Delta^2q_0u)/(2\pi\kappa\hbar^3nvl)\approx(1\text{-}10)\ \text{GHz}, \quad (23)$$

is unstable. At parameters, satisfying the inequality (21), there exists a frequency interval $\omega_1<\omega^*<\omega_2$ which becomes unstable under pumping.

To conclude, we have shown that generation of high frequency phonons with frequencies of order of GHz can be achieved in ferromagnetic half-metals, when the conditions for magnon instability are fulfilled.

The main source of phonon damping in half-metals is phonon-electron scattering. From this point of view high $T_c$ ferromagnetic insulators with laser pumping of spin-down electrons would be preferable.

The above discussion has set forth the operation of various exemplary systems and devices, as well as various embodiments pertaining to exemplary methods of operating such systems and devices. In various embodiments, one or more steps of a method of implementation are carried out by a processor under the control of computer-readable and computer-executable instructions. Thus, in some embodiments, these methods are implemented via a computer.

In an embodiment, the computer-readable and computer-executable instructions may reside on computer useable/readable media.

Therefore, one or more operations of various embodiments may be controlled or implemented using computer-executable instructions, such as program modules, being executed by a computer. Generally, program modules include routines, programs, objects, components, data structures, etc., that perform particular tasks or implement particular abstract data types. In addition, the present technology may also be practiced in distributed computing environments where tasks are performed by remote processing devices that are linked through a communications network. In a distributed computing environment, program modules may be located in both local and remote computer-storage media including memory-storage devices. The present technology may also be implemented in real time or in a post-processed or time-shifted implementation where sufficient data is recorded to permit calculation of final results at a later time.

Although specific steps of exemplary methods of implementation are disclosed herein, these steps are examples of steps that may be performed in accordance with various exemplary embodiments. That is, embodiments disclosed herein are well suited to performing various other steps or variations of the steps recited. Moreover, the steps disclosed herein may be performed in an order different than presented, and not all of the steps are necessarily performed in a particular embodiment.

Although various electronic and software based systems are discussed herein, these systems are merely examples of environments that might be utilized, and are not intended to suggest any limitation as to the scope of use or functionality of the present technology. Neither should such systems be interpreted as having any dependency or relation to any one or combination of components or functions illustrated in the disclosed examples.

Although the subject matter has been described in a language specific to structural features and/or methodological acts, the subject matter defined in the appended claims is not necessarily limited to the specific features or acts described above. Rather, the specific features and acts described above are disclosed as exemplary forms of implementing the claims.

What is claimed is:

1. An apparatus for generating ultra-high frequency sound waves comprising:

a ferromagnetic conductive material including a magnetic phonon-gain medium; wherein non-equilibrium electrons having the spin orientation opposite to the direction of magnetization of said magnetic phonon-gain medium are injected into said ferromagnetic material; wherein non-equilibrium magnons are generated in said magnetic phonon-gain medium while said non-equilibrium electrons propagate in said magnetic phonon-gain medium and change the spin orientation from the direction opposite to the direction of magnetization of said magnetic phonon-gain medium to the direction along to the direction of magnetization of said magnetic phonon-gain medium; wherein said ultra-high frequency non-equilibrium phonons are generated in said magnetic phonon-gain medium by non-equilibrium magnons having the magnon velocity exceeding the sound velocity in said magnetic phonon-gain medium; said non-equilibrium magnons having the magnon velocity exceeding the sound velocity in said magnetic phonon-gain medium being generated by said injected non-equilibrium electrons having spin opposite to the direction of magnetization of said magnetic phonon-gain medium;

a means for outputting said ultra-high frequency non-equilibrium phonons generated in said magnetic phonon-gain medium by non-equilibrium magnons having the magnon velocity exceeding the sound velocity in said magnetic phonon-gain medium;

and a tunnel junction coupled to said ferromagnetic conductive material; wherein electrons are injected into said ferromagnetic conductive material from an external metallic contact by tunneling via said tunnel junction.

2. The apparatus of claim 1 further comprising:

said external metallic contact coupled to said tunnel junction; wherein an external power source is configured to inject electron current using said external metallic contact into said ferromagnetic conductive material by tunneling via said tunnel junction.

3. The apparatus of claim 2 further comprising:

a bias voltage source applied to said external metallic contact; wherein said applied bias voltage is configured to shift the Fermi level of said external metallic contact with respect to the Fermi level of said ferromagnetic conductive material.

4. The apparatus of claim 1, wherein said ferromagnetic conductive material is selected from the group consisting of:

a ferromagnetic semiconductor; a dilute magnetic semiconductor (DMS); a half-metallic ferromagnet (HMF); and a ferromagnetic conductor, with a gap in the density of states of the minority electrons around the Fermi energy.

5. The apparatus of claim 4, wherein said half-metallic ferromagnet (HMF) is selected from the group consisting of:

a spin-polarized Heusler alloy; a spin-polarized Colossal magnetoresistance material; and $CrO_2$.

6. The apparatus of claim 5, wherein said spin-polarized Heusler alloy is selected from the group consisting of:

$Co_2FeAl_{0.5}Si_{0.5}$; NiMnSb; $Co_2MnSi$; $Co_2MnGe$; $Co_2MnSn$; $Co_2FeAl$ and $Co_2FeS$.

7. The apparatus of claim 1, wherein said tunnel junction is selected from the group consisting of:

a thin insulating layer between said contact and said ferromagnetic conductive material; and a bias between said contact and said ferromagnetic conductive material.

8. The apparatus of claim 1, wherein said means for outputting said ultra-high frequency non-equilibrium phonons further comprises:

an external ultra-high frequency sound wave-guide attached to a surface area of said magnetic phonon-gain medium; wherein said external ultra-high frequency sound wave-guide is configured to output an amplified stream of ultra-high frequency sound; said amplified stream of ultra-high frequency sound having a frequency located in the range between 1 GHz and 10 GHz.

9. A method for generation of nonequilibrium magnons by using an apparatus comprising a ferromagnetic conductive material including a magnetic phonon-gain medium, a means for outputting ultra-high frequency non-equilibrium phonons generated in said magnetic phonon-gain medium by non-equilibrium magnons having the magnon velocity exceeding the sound velocity in said magnetic phonon-gain medium, and a tunnel junction coupled to said ferromagnetic conductive material; said method comprising:

(A) applying bias voltage to shift a Fermi level of said external metallic contact with respect to an exchange energy gap of said ferromagnetic conductive material;

(B) injecting non-equilibrium electrons into said magnetic phonon-gain medium via said tunnel junction; said injected non-equilibrium electrons having the spin orientation opposite to the direction of magnetization of said magnetic phonon-gain medium;

(C) generating non-equilibrium magnons in said magnetic phonon-gain medium; wherein said non-equilibrium magnons are generated in said magnetic phonon-gain medium while said non-equilibrium electrons propagate in said magnetic phonon-gain medium and change the spin orientation from the direction opposite to the direction of magnetization of said magnetic phonon-gain medium to the direction along to the direction of magnetization of said magnetic phonon-gain medium;

and (D) generating ultra-high frequency non-equilibrium phonons in said magnetic phonon-gain medium; wherein said ultra-high frequency non-equilibrium phonons are generated in said magnetic phonon-gain medium by non-equilibrium magnons having the magnon velocity exceeding the sound velocity in said magnetic phonon-gain medium; said non-equilibrium magnons having the magnon velocity exceeding the sound velocity in said magnetic phonon-gain medium being generated by said injected non-equilibrium electrons having spin opposite to the direction of magnetization of said magnetic phonon-gain medium.

10. The method of claim 9, wherein said step (B) further comprises:

(B1) selecting said ferromagnetic material from the group consisting of:

a ferromagnetic semiconductor; a dilute magnetic semiconductor (DMS); a half-metallic ferromagnet (HMF); and a ferromagnetic conductor, with a gap in the density of states of the minority electrons around the Fermi energy.

11. The method of claim 10, wherein said step (B1) further comprises:

(B 1, 1) selecting said half-metallic ferromagnet (HMF) from the group consisting of:

a spin-polarized Heusler alloy; a spin-polarized Colossal magnetoresistance material; and $CrO_2$.

12. The method of claim 11, wherein said step (B1, 1) further comprises:

(B 1, 1, 1) selecting said spin-polarized Heusler alloy is selected from the group consisting of:

$Co_2FeAl_{0.5}Si_{0.5}$; NiMnSb; $Co_2MnSi$; $Co_2MnGe$; $Co_2MnSn$; $Co_2FeAl$ and $Co_2FeS$.

13. The method of claim 9, wherein said step (B) further comprises:

(B2) selecting said tunnel junction from the group consisting of:

a thin insulating layer between said contact and said ferromagnetic conductive material; and a bias between said contact and said ferromagnetic conductive material.

14. The method of claim 9, wherein said step (D) further comprises:

(D1) generating said amplified stream of ultra-high frequency sound having a frequency located in the range between 1 GHz and 10 GHz.

15. The method of claim 14, wherein said step (D1) further comprises:

(D1, 1) changing the frequency of said generated amplified stream of ultra-high frequency sound by changing the geometrical dimensions of said magnetic phonon-gain medium.

16. The method of claim 9 further comprising:

(E) outputting said generated amplified stream of ultra-high frequency sound into an external ultra-high frequency sound wave-guide attached to a surface area of said magnetic phonon-gain medium.

* * * * *